US005617580A

United States Patent [19]

DiCesare et al.

[11] Patent Number: 5,617,580

[45] Date of Patent: Apr. 8, 1997

[54] GOALIE PAD COVERS

[76] Inventors: Vince DiCesare, 23 Sycamore Drive, Nepean, Ontario, Canada, K2H 6R4; Grant P. Conrad, 109 Russell Avenue, Ottawa, Ontario, Canada, K1N 7X2; Thomas J. Flood, 8 Tamblyn Crescent, Kanata, Ontario, Canada, K2L 3A4

[21] Appl. No.: 390,550

[22] Filed: Feb. 17, 1995

[30] Foreign Application Priority Data

Jan. 30, 1995 [CA] Canada ..... 2141374

[51] Int. Cl.[6] ..... A41D 13/00

[52] U.S. Cl. ..... 2/22; 2/455; 2/911

[58] Field of Search ..... 2/2, 22, 23, 24, 2/46, 911; 273/57.2; 150/154

[56] References Cited

U.S. PATENT DOCUMENTS

| | | |
|---|---|---|
| 3,877,077 | 4/1975 | Chapdelaine . |
| 4,461,030 | 7/1984 | Knudsen . |
| 4,484,360 | 11/1984 | Leighton et al. . |
| 4,512,037 | 4/1985 | Vacanti . |
| 4,700,406 | 10/1987 | Meistrell . |
| 4,715,067 | 12/1987 | Beauregard . |
| 4,868,926 | 9/1989 | Lowson ..... 2/22 |
| 5,093,931 | 3/1992 | LaBerge et al. . |
| 5,107,823 | 4/1992 | Fratesi . |
| 5,172,425 | 12/1992 | Smith . |
| 5,307,521 | 5/1994 | Davis . |
| 5,328,652 | 7/1994 | Thomson . |

FOREIGN PATENT DOCUMENTS

| | | |
|---|---|---|
| 1161603 | 2/1984 | Canada . |
| 1173203 | 8/1984 | Canada . |
| 2063814 | 1/1991 | Canada . |
| 1280552 | 2/1991 | Canada . |
| 1310795 | 12/1992 | Canada . |
| 2071672 | 12/1993 | Canada . |
| 0455348 | 11/1991 | European Pat. Off. . |
| WO8808676 | 11/1988 | WIPO . |
| WO9101095 | 2/1991 | WIPO . |

*Primary Examiner*—Michael A. Neas
*Attorney, Agent, or Firm*—Heslin & Rothenberg, P.C.

[57] ABSTRACT

The present invention relates to a goalie pad cover designed to provide protection to a goalie pad from abrasion in sports such as ice hockey, in-line skate hockey or road hockey. The cover is tight fitting to the outer surface of the goalie pad so as to not interfere with normal use of the pad. The cover may be provided with plastic ribs or surfaces at the high wear areas of the cover to prevent abrasion of the cover and to provide sliding surfaces to enable the cover to slide on different surfaces. In fitting the goalie pad cover to a goalie pad, the cover is provided with a plurality of attachment and conforming devices which hold the cover to the goalie pad as well as tightly conforming the cover to the goalie pad surface. The attachment and conforming devices may comprise a system of straps, wire ties and washers to attach and conform the cover to the goalie pad.

25 Claims, 7 Drawing Sheets

GOALIE PAD COVERS

FIELD OF THE INVENTION

The present invention relates to a goalie pad cover designed to provide protection to a goalie pad from abrasion in sports such as ice hockey, in-line skate hockey or road hockey. The cover is tight fitting to the outer surface of the goalie pad so as to not interfere with normal use of the pad. The cover may be provided with plastic ribs or surfaces at the high wear areas of the cover to prevent abrasion of the cover and to provide sliding surfaces to enable the cover to slide on different surfaces. In fitting the goalie pad cover to a goalie pad, the cover is provided with a plurality of attachment and conforming devices which hold the cover to the goalie pad as well as tightly conforming the cover to the goalie pad surface. The attachment and conforming devices may comprise a system of straps, wire ties and washers to attach and conform the cover to the goalie pad.

BACKGROUND OF THE INVENTION

Goalie pads are used in a variety of sports to provide protection to a goalie from a particular game's ball, puck or object of play in addition to enhancing the goalie's ability to perform his/her goal-keeping skills.

For example, in ice-hockey, a goalie's pads are designed to provide protection to the goalie's feet, ankles, shins, knees, and thighs from a puck in play. In addition to protecting the goalie, the goalie pads also effectively increase the blocking area of the goalie with respect to the goal by the width of the goalie pads while simultaneously providing a satisfactory level of mobility to the goalie while the pads are fitted to the goalie's legs. Furthermore, a hockey goalie's pads are designed to help keep rebound shots that bounce off the goalie pads in front of the goalie by providing a pad bar on the outer or lateral edges of the goalie pad. The pad bar provides a raised section on the goalie pad which enhances the deflection of a shot towards the centre of the goalie which is a position where the goalie can more easily recover or play the puck. The goalie pads as a whole also provide an energy absorbing surface that cushion the impact of a puck to further control rebounds.

The overall shape and configuration of a goalie pad is a complex three-dimensional structure which provides the above characteristics. A goalie pad is also a durable piece of equipment to adequately endure the rigours of normal use.

As a result of the shape and construction, goalie pads are typically expensive pieces of sports equipment which are subjected to relatively high wear and tear during normal use. However, in spite of their durable construction, goalie pads periodically need to be repaired or replaced.

The preferred materials for the outer surface of a goalie pad are natural or synthetic leather or tear resistant nylon in view of these material's abrasion resistance and ease of repair. The use of these materials as a material for goalie pads is, however, subject to numerous limitations. For example, during normal use, goalie pads typically wear out in specific high-wear areas and require unsightly repairs, such as leather patches, glued or stitched in place, to cover cuts in the leather or thin or broken leather in the high-wear areas of the goalie pad. Natural leather also absorbs water which requires that the goalie pad be properly dried after play to prevent mildewing of the goalie pad.

In recent years, synthetic leather has been found to be more effective than natural leather in terms of wear resistance and weight and, as a result, has been used for the high-wear areas of the goalie pad or for the entire pad. Goalie-pads may also be constructed of other suitable fabrics which provide high wear and tear resistance. It should, however, be noted that all materials currently used in the construction of goalie pads, are subject to the above limitations to varying degrees, in view of the nature of the use of a goalie pad.

Accordingly, in view of these limitations, there has been a need for a cover for a goalie pad that provides protection to the outer surface of a goalie pad, that reduces the normal wear to the outer surface of the goalie pad and that reduces the amount of water contacting the leather surface. Accordingly, there has been a need for a goalie pad cover that is conformed tightly to the outer surface of the goalie pad to provide protection to the goalie pad without interfering with the normal use of the goalie pad.

It is also known that many goalies are members of teams having uniforms and, accordingly, it is also desirable that a goalie's pads are coordinated with the colours or logos of a particular team. In the past, goalie's pads were coordinated to a particular team's colours or logos by painting the outer leather surface of the goalie pad. Depending on the particulars of painting individual goalie pads, it is often required to disassemble the goalie pads in order to accurately paint within the deep crevices of a particular pad. Disassembly, painting and re-assembly of a goalie pad is a difficult, time-consuming, and expensive undertaking, and ultimately, affects the structural integrity of the goalie pad. Furthermore, in that a painted leather goalie pad is subjected to direct contact with the playing surface, the leather frequently requires reapplication of paint after a relatively short period of time.

A single goalie may also play for different teams with different uniforms. In this situation, an individual goalie will either forgo coordination of the goalie pads to the team's colours or have separate pads for each uniform. Accordingly, there has been a need for a goalie pad cover that may be constructed of materials that may be coordinated to a particular team's colours or logos where the goalie pad cover may be quickly and easily configured to the goalie pad, where through different goalie pad cover sets, provide the flexibility of configuring one set of goalie pads to any number of colours or logos.

In recent years, the growth of in-line skating has resulted in an increase in the popularity of in-line skate hockey. In-line skate hockey is typically played by ice-hockey players in the off-season or as a sport distinct in itself. In-line hockey is often played on the smooth concrete surface of an ice arena without the ice or on normal road surfaces. As a result, the use of regular goalie pads on such surfaces significantly contributes to the wear and tear on the goalie pad. Furthermore, the rougher and/or less slippery surface of concrete or a road inhibits a goalie's ability to slide to block a shot on goal which may contribute to injury or decreased goalie performance. Thus, there has also been a need for a goalie pad cover which provides protection to a goalie pad when used for in-line skate hockey or road hockey and, in particular, there has been a need for a goalie pad cover that enhances the goalie's ability to slide while providing significant protection to the goalie pad from abrasion.

As indicated previously, a goalie pad is a complex three-dimensional structure which varies in design from manufacturer to manufacturer. When worn by different goalies, one particular design may be less effective at stopping shots in view of the particular stance adopted by an individual goalie or the specific design of the goalie pad. Accordingly, there has been a need for a goalie pad cover that enables a goalie to "add to" his or her goalie pad in areas where the goalie pad's design is deficient in padding as a result of the goalie's particular stance or the particular design of the goalie pad. Thus, there has been a need for a pad that provides a goalie with the option of adding material to the goalie pad surfaces to enhance padding at a particular location of the goalie pad between the cover and pad.

It is also well known that particular designs or models of goalie pads require a period of "break-in" before a goalie is satisfied with the rebound characteristics of the pads. Often, break-in periods can last many months as the leather and padding of the pad becomes worked and the rebound characteristics stabilize. Accordingly, there has also been a need for a goalie pad cover that provides a goalie with the option of adding a rebound controlling material between the cover and the goalie pad to provide pads with a desirable rebound during the break-in period.

In consideration of all of the above problems, there has been a need for lightweight goalie pad covers that address each of these problems. Specifically, there has been a need for goalie pad covers that do not considerably increase the weight of goalie pads nor interfere with the normal use of the goalie pads in a game, that decrease the frequency of repairs to the goalie pads as a result of abrasion, that protect the pads against wear and tear, that keep the goalie pads looking new to enhance re-sale or the longevity of use of the goalie pads, that enable older goalie pads to be used without unsightly repairs showing, that enable worn pads to be quickly repaired by the cover alone, that provide the flexibility to conform goalie pads to a team colour or uniform, that enables adaptation of the goalie pad to a particular colour or logo scheme without affecting the structural integrity of the pad, that in the case of ice-hockey do not build up snow or ice during play, and that in the case of ice, in-line skate and road hockey increase the ability of a goalie to slide during play.

Furthermore, there has been a need for a goalie-pad cover that can be quickly and easily configured to the goalie pad and that is readily adaptable to a plurality of different goalie pad sizes and designs with a simple connection system.

There has also been a need for a goalie pad cover that can be produced at a cost much less than the cost of new goalie pads.

The prior art does not teach or provide solutions to the above problems. For example, U.S. Pat. No. 4,512,037 discloses a protective pad assembly, U.S. Pat. No. 4,715,067 discloses a goal-keeper pad, U.S. Pat. No. 5,172,425 discloses a knee joint for a goalie pad and U.S. Pat. No. 5,307,521 discloses a protective device for horses.

SUMMARY OF THE INVENTION

In accordance with the invention, a goalie pad cover is provided for use with a goalie pad having top, bottom, front, back, medial and lateral surfaces, the goalie pad cover comprising:

a plurality of interconnected panels conforming to the surfaces of the goalie pad, attachment means on the interconnected panels for holding the interconnected panels to the surfaces of the goalie pad;

conforming means on the inner surface of the interconnected panels for tightly holding the panels against concave surfaces of the goalie pad.

In one form of the invention, the plurality of interconnected panels include top, thigh, pad bar, knee, shin, and boot panels and the attachment means include top, bottom, and side attachment means.

In one specific embodiment, the top attachment means is a pocket for engagement over and around the thigh section, the pocket formed by the top, thigh and pad bar panels and the bottom attachment means comprises left and right toe panels on the boot panel for engagement with respective left and right sides of the bottom surface of the goalie pad.

In another embodiment, the interconnected panels are provided with slide means for reducing wear to the interconnected panels and for increasing the sliding coefficient of the goalie pad cover on a playing surface.

In a specific embodiment, the sliding surfaces are on the medial surface, left and right toe panels and knee panel of the goalie pad cover.

In a specific embodiment, the conforming means of the goalie pad cover comprises:

anchoring strip on the interconnected panels for engagement with wire ties, the wire ties each having a first end for engagement with the anchoring strip and a second end for passing from the front to rear surfaces of the goalie pad;

washers for engagement with the second end of the wire tie on the rear surface of the goalie pad;

locking nut for anchoring the second end of the wire tie on the rear surface of the goalie pad.

In still alternate embodiments of the invention, the attachment means are selected from any one of or a combination of straps, laces or buttons between the goalie pad cover and goalie pad and the conforming means are selected from any one of or a combination of hooks and clasps, laces, buttons or wire ties between the goalie pad cover and goalie pad.

In a preferred embodiment, the interconnected panels are assembled from any one of or a combination of panels of tear-resistant nylon, synthetic leather and polyethylene.

In another embodiment, the goalie pad cover provides the option for selectively providing additional padding to the goalie pad between the cover and goalie pad.

In a specific embodiment of the invention, a goalie pad cover is provided, the goalie pad cover having inner and outer surfaces for use with a goalie pad having padded thigh, knee, shin, boot, and pad bar sections comprising:

pad bar panel for covering the pad bar section;

thigh panel attached to the pad bar panel for covering the thigh section;

knee panel attached to the thigh panel and pad bar panel for covering the knee section;

shin panel attached to the knee panel and pad bar panel for covering the thigh section;

boot panel attached to the shin panel and pad bar panel for covering the boot section;

left and right side toe panels attached to the left and right side of the boot panel respectively for holding the boot panel against the underside of the boot section;

top panel attached to thigh panel and pad bar panel, the top, thigh and pad bar panels forming a pocket for engagement over and around the thigh section;

conforming means on the inner surface of the goalie pad cover, the conforming means having:

anchoring strip on the interconnected panels for engagement with wire ties, the wire ties each having a first end for engagement with the anchoring strip and a second end for passing from the front to rear surfaces of the goalie pad;

washers for engagement with the second end of the wire tie on the rear surface of the goalie pad;

locking nut for anchoring the second end of the wire tie on the rear surface of the goalie pad.

BRIEF DESCRIPTION OF THE DRAWINGS

These and other features of the invention will be more apparent from the following description in which reference is made to the appended drawings wherein.

DETAILED DESCRIPTION OF THE INVENTION

Figure 1:
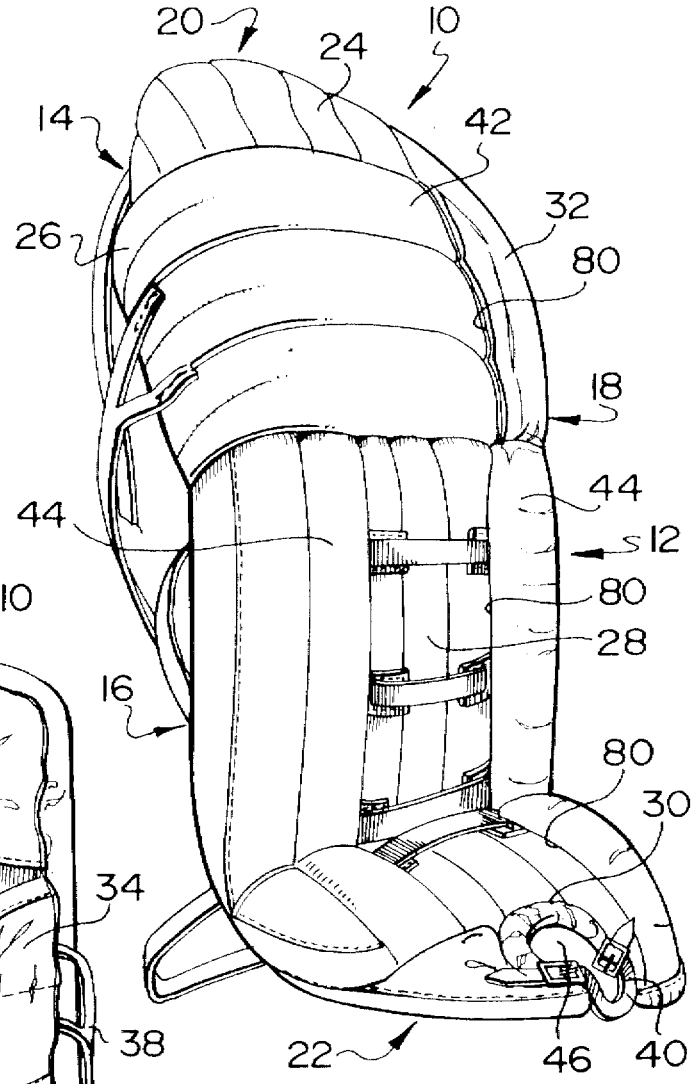
FIG. 1 PRIOR ART
FIG. 1 is a front perspective view of a typical goalie pad.
Figure 2:
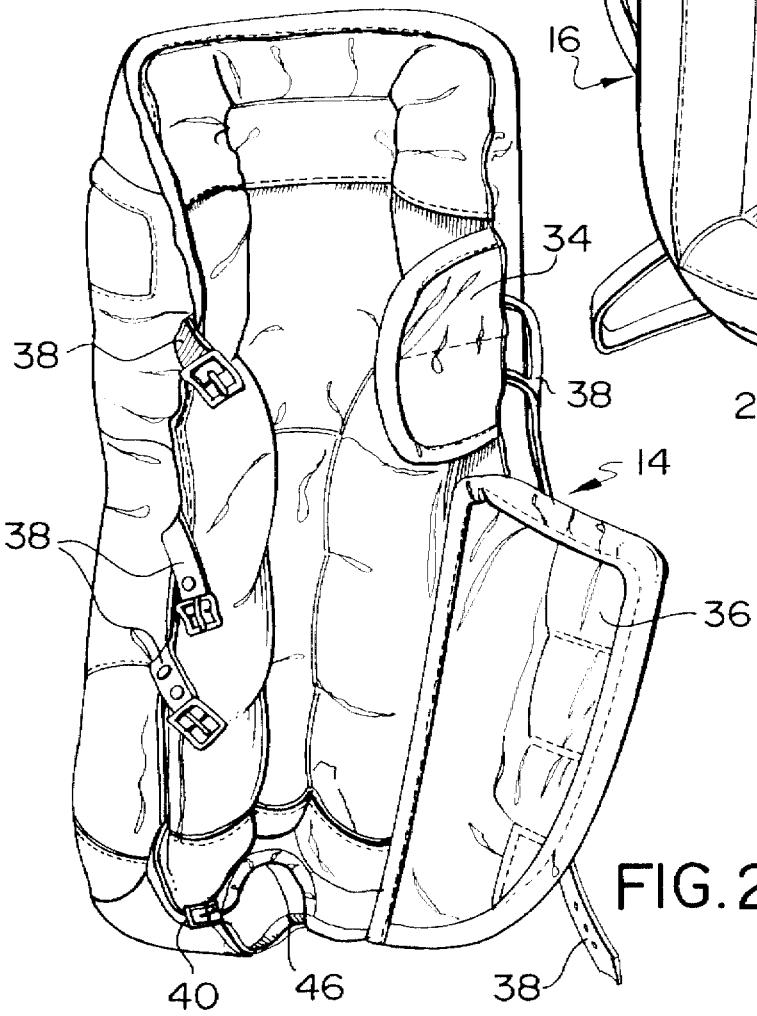
FIG. 2 PRIOR ART
FIG. 2 is a rear perspective view of a typical goalie pad.

FIG. 1 is a typical goalie pad 10 used in ice, in-line skate and/or road hockey. As shown, a typical goalie pad 10 generally has front 12, back 14, medial 16, lateral 18, top 20 and bottom 22 surfaces. The goalie pad 10 is assembled in a number of sections including a thigh section 24, knee section 26, shin section 28, and boot section 30 for providing protection to the corresponding areas of a goalie's leg. The goalie pad 10 is also provided with a pad bar section 32 along the lateral edge 18 to provide a raised surface along the lateral edge 18. As is seen in FIG. 2, the rear surface 14 is provided with knee back panel 34 and shin back panel 36 to provide protection to the back of the goalie's leg. The knee and shin back panels 34 and 36 and goalie pad 10 are attached around the goalie's leg by straps 38 located on the back surface 14 of the goalie pad 10. Boot section 30 is also provided with skate/boot opening 46 for accommodation of a skate or boot (not shown). The boot section 30 is attached to the underside of the goalie's skate or boot by boot strap 40.

As is seen in FIG. 1, each section of a goalie pad 10 is typically constructed of a plurality of horizontal and vertical pads, 42 and 44 respectively, which enhance the functional use of the goalie pad 10. For example, the knee section 26 is normally constructed of a plurality of horizontal pads in order to provide the goalie pad with a degree of flexion thereby allowing the goalie to bend their knee. Furthermore, the pad bar section 32 may normally comprise a number of vertical pads 44 aligned end to end and projecting above the front surface 12 of the goalie pad 10 along the lateral edge 18 to provide a raised surface. The raised surface is provided to enhance deflection of a puck or playing object towards the centre and in front of the goalie during play.

Figure 4:
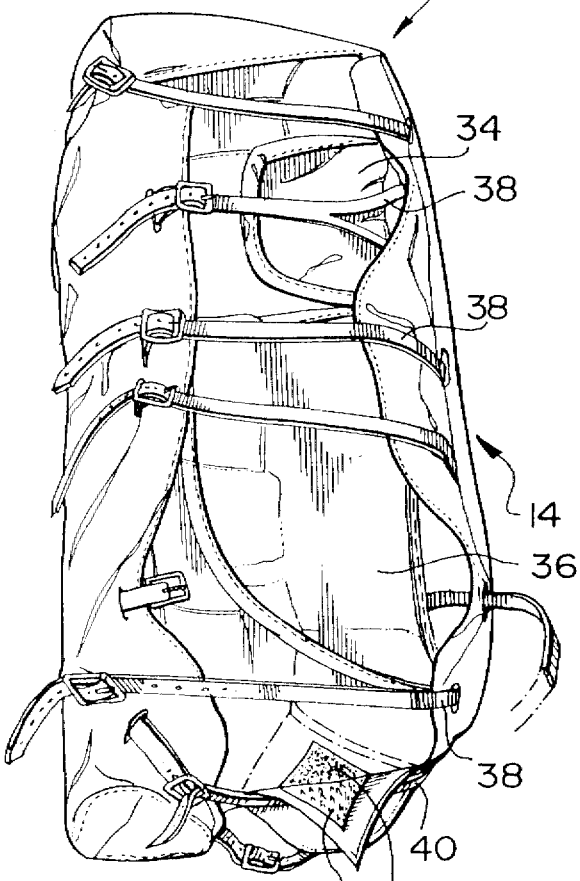
FIG. 4 is a rear perspective view of a typical goalie pad with a goalie pad cover in accordance with the invention.
Figure 3:
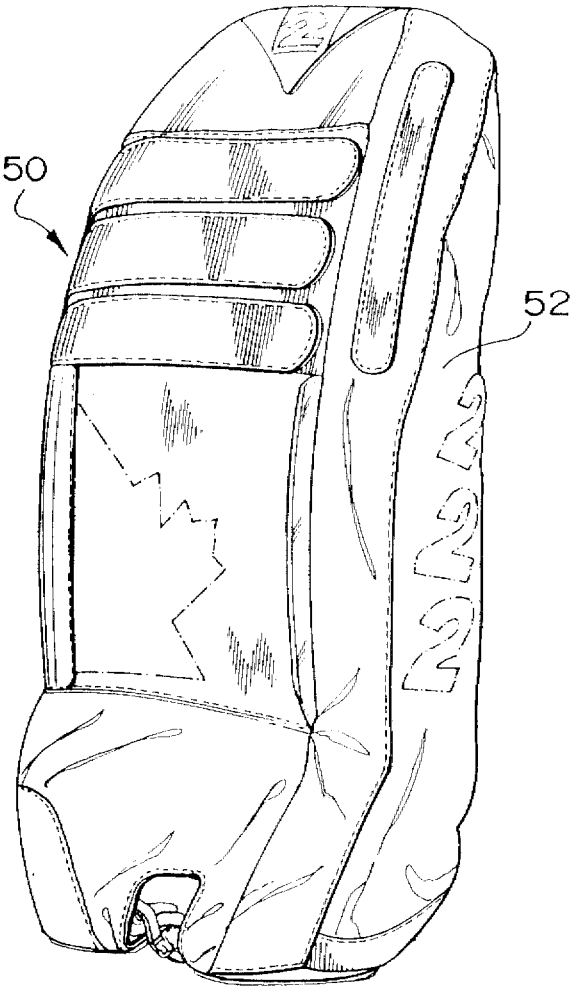
FIG. 3 is a front perspective view of a typical goalie pad with a goalie pad cover in accordance with the invention.

With reference to FIGS. 3 and 4, a goalie pad cover 50 in accordance with the invention is shown configured to a goalie pad 10. The goalie pad cover 50 is provided with a plurality of panels 52, interconnected with respect to one another, which enable the goalie pad cover 50 to be tightly attached and conformed to the outer surfaces of the goalie pad 10 while enabling the goalie pad 10 to be attached to and removed from a goalie's leg (not shown) in the normal manner.

Figure 5:
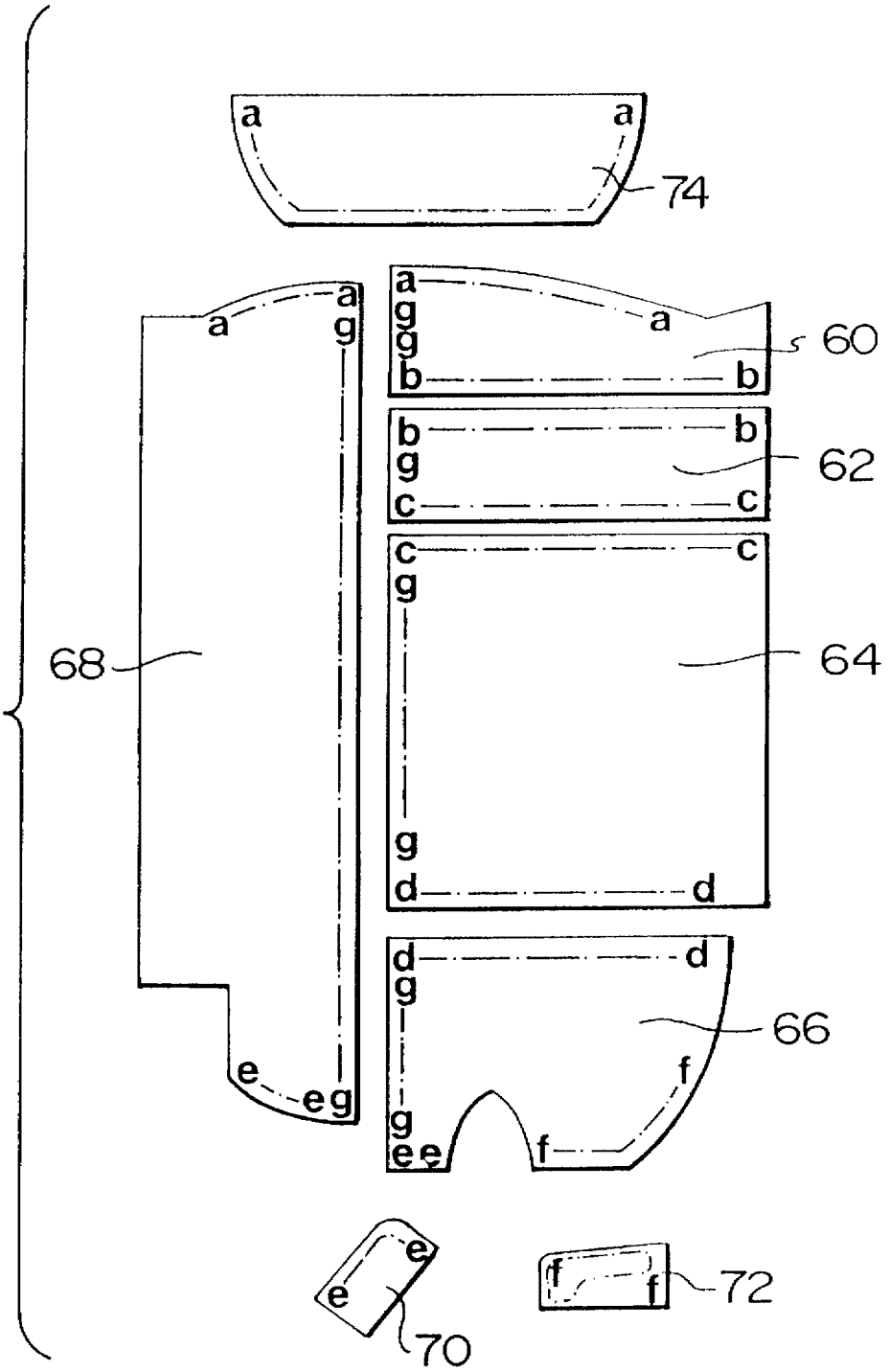
FIG. 5 is a plan view of the unassembled panels in accordance with the goalie pad cover of the invention showing connecting surfaces.

A typical layout of the panels 52 of a goalie pad cover 50 in accordance with the invention is shown in FIG. 5. It is understood that within the spirit and scope of the invention, the specific geometric layout of the various panels 52 may be varied to provide a tight fitting cover for a particular design of goalie pad 10 and that the design shown in FIG. 5 is merely representative of a goalie pad cover 50 for one particular goalie pad design.

The panels 52 generally conform to corresponding sections of the goalie pad 10. Accordingly, there is provided a thigh panel 60, a knee panel 62, a shin panel 64, a boot panel 66, and pad bar panel 68. In addition, the goalie pad cover 50 is provided with underside boot panels 70 and 72 and top panel 74. The underside boot panels 70 and 72 hold the cover 50 on the bottom 22 surface of the goalie pad 10 and the top panel holds the cover 50 on the top 20 surface of the goalie pad 10 on the thigh section 24.

The panels 52 are interconnected by any suitable means to provide a durable connection between the panels 52. Such interconnection means may include but are not limited to sewing, glue, rivets, heat sealing or any reasonable combination thereof. A typical interconnection pattern is shown along the edges of respective panels by letters a, b, c, d, e, f, and g where letters on adjacent panels are joined by an appropriate interconnecting means. In a preferred embodiment of the invention, the panels 52 are sewn together. Interconnection of the panels 52 provides a three-dimensional surface for configuration of the cover 50 to the goalie pad 10.

Figure 6A:
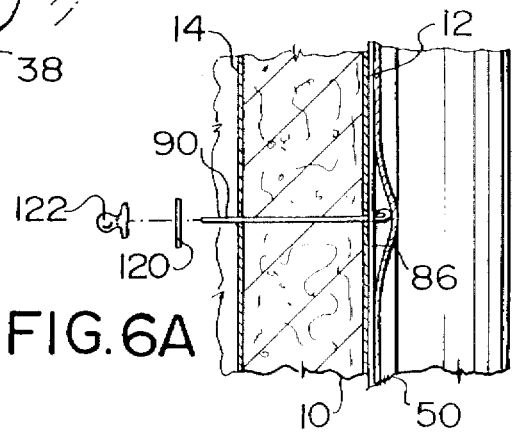
FIG. 6A is a cross-sectional view of one embodiment of the conforming means assembled on a goalie pad
Figure 6:
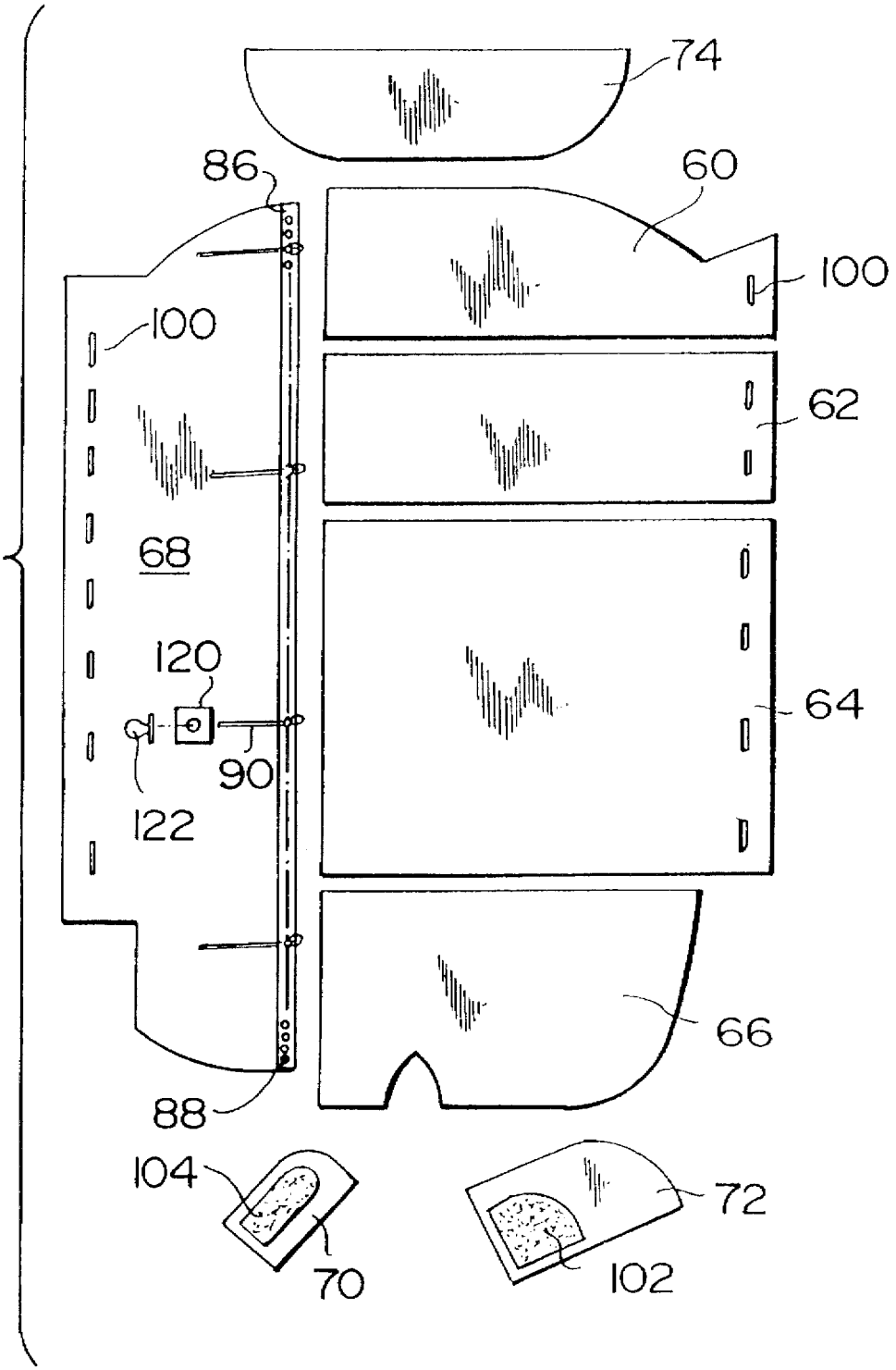
FIG. 6 is a plan view of the unassembled panels in accordance with the goalie pad cover of the invention showing one embodiment of the attachment and conforming means.

The cover 50 is also provided with attachment devices to enable the cover to be tightly attached to the outer surfaces of the goalie pad 10 without interfering with the goalie's ability to put the goalie pads on. As is seen in FIGS. 4, 5 & 6, the goalie pad cover 50 is held to the goalie pad 10 by a combination of devices to provide a tight form-fitting cover. As shown, the top of the cover 50 is provided with top panel 74 which forms a top pocket with the thigh 60 and pad bar 68 panels for insertion of the thigh section 24.

By pulling the cover 50 tightly down, the top pocket is firmly engaged with the thigh section 24. The underside boot panels 70 and 72 are pulled down and underneath to the underside of the boot section 30 and are attached to the underside of the boot section 30 by a suitable fastening device. For example, for one particular design of goalie pad a VELCRO™ type fastener may be used where a VELCRO™ panel 103 is adhered to the underside of the boot section 30 and the corresponding VELCRO™ panel 102 and 104 is adhered to the underside boot panels 70 and 72. Other bottom fasteners may include but are not limited to buttons, laces, elastics or straps.

The cover 50 is drawn tightly around the medial 16 and lateral 18 surfaces of the goalie pad 50 by straps 38. As seen in FIG. 5 the outside edges of the pad bar panel 68, thigh panel 60, knee panel 62, shin panel 64, and boot panel 66 may be provided with a number of strap holes 100 through which the straps 38 may be inserted. The strap holes 100 may be reinforced by any suitable means, such as stress-release washers or sewn buttonholes which prevent fraying or ripping of the strap holes 100. Tightening the straps 38, as for example when the goalie is putting the pads 10 on, tightens the cover 50 around the goalie pad 10. In another form, an auxiliary tightening system is provided where the lateral 18 and medial surfaces 16 of the goalie pad 10 are provided with eyelets and the inside surface of the cover 50 is provided with laces to enable the cover 50 to be independently laced or attached to the goalie pad 10.

The cover 50 is also provided with conforming devices to enable the cover 50 to be tightly formed to the front surface of the goalie pad 10 and, in particular, to the concave outer surfaces 80 of the goalie pad 10. Concave surfaces 80 are typically present adjacent and medial to the pad bar 32, knee 26, thigh 28 and boot 30 sections respectively of the goalie pad 10. As shown in FIG. 6, conforming devices are located at appropriate positions on the underside surface of the interconnected panels 52. In order to anchor the cover 50 against the concave surfaces 80, in one embodiment, the conforming device is passed through the goalie pad from the front 12 to back 14 surface of the goalie pad 10 either through existing channels, for example through the channels used for straps 38, or through specifically made channels. In the event that the goalie pad 10 requires specific channels to be made, it is preferred that these channels are made between adjacent pad sections 42 or 44 where the least amount of padding is located. The conforming device may be any suitable device which enables the interconnected panels 52 to be drawn tightly against the front surface 12 and concave surfaces 80 of the goalie pad 10 and that is sufficiently strong to provide durability to prevent breakage during play. For example, suitable conforming devices may be wire, cord, or plastic ties that may be drawn through the goalie pad and anchored to the back surface 14 or the pad 10. Furthermore, the conforming device must be suitably anchored to the back surface of the cover 50. In a preferred embodiment (FIGS. 6 and 6A) of a conforming device, a strip of durable plastic 86 (for example, polyethylene) is attached to the rear surface of the pad bar panel 68 adjacent the medial edge where the pad bar panel 68 is attached to the other panels 52. The plastic strip 86 is provided with a plurality of holes 88 which enables one end of a wire 90 with an enlarged or hooked end to be inserted within a particular hole 88 in order to lock the wire 90 against the plastic strip 86. The free end of the wire 90 is passed to the back surface 14 as described above and pulled to draw cover 50 within the concave surface 80. A washer 120 and locking nut 122 are provided to secure the free end of the wire 90 against the rear surface 14 of the goalie pad. In this manner, the washer 120 provides force distribution for the locking nut 122. It is understood that other devices may be used to anchor the cover 50 within the concave surface 80 within the spirit and scope of the invention, such as but not being limited to hooks and clasps, buttons, elastics, laces or butterfly clasps.

It is also understood that the particular location of each conforming device may be varied in accordance with the specific design of a goalie pad 10 and may require one or more conforming devices at different locations of the cover 50 to provide complete conformation. An example of an alternative design for conforming and attaching the cover includes rigid three-dimensional plastic molded panels replacing one or more flexible panels. In this case, rigid boot sections may replace the flexible panels around the boot sections of the cover.

Figure 7:
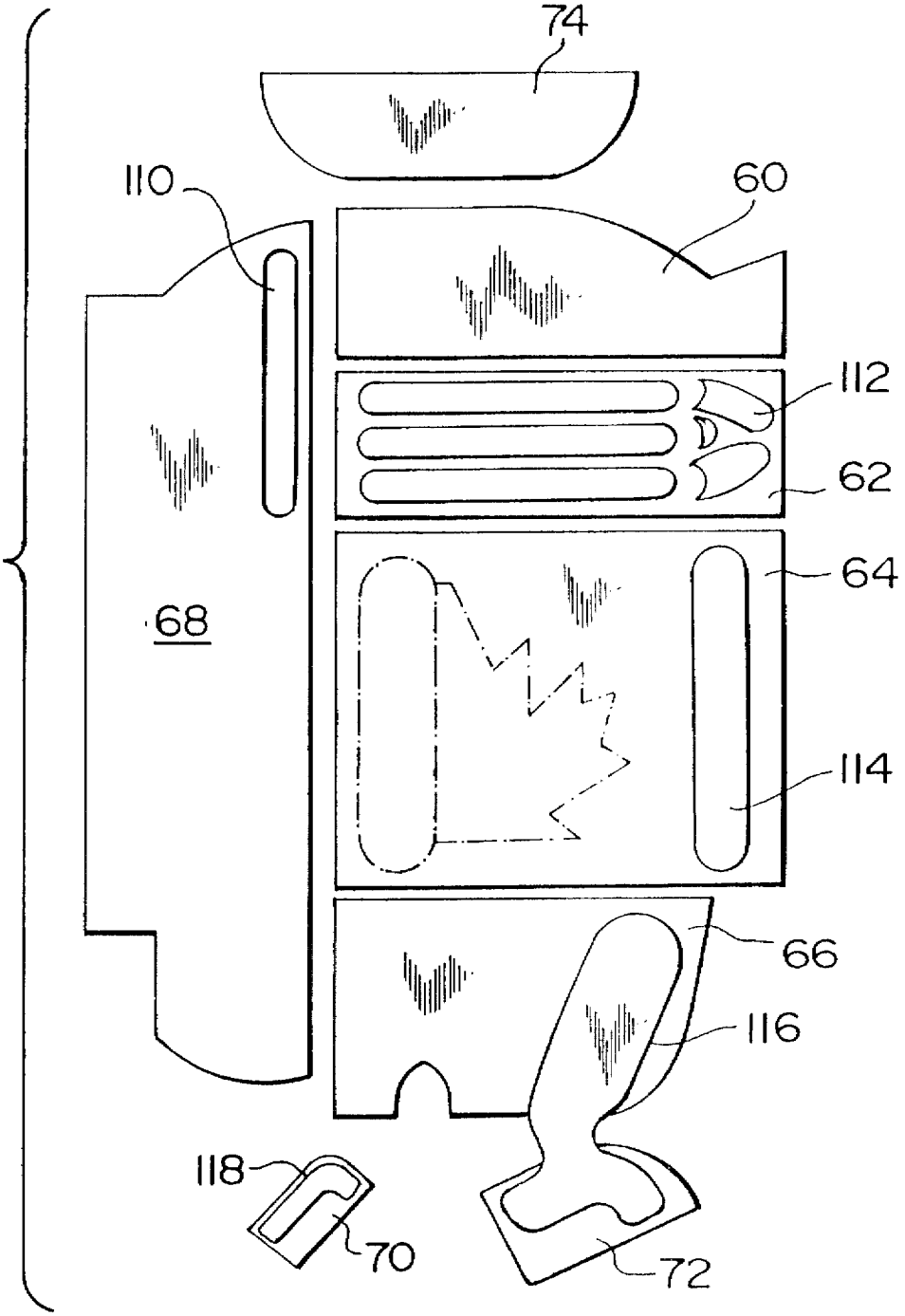
FIG. 7 is a plan view of the unassembled panels in accordance with the goalie pad cover of the invention showing the sliding surfaces.
Figure 8:
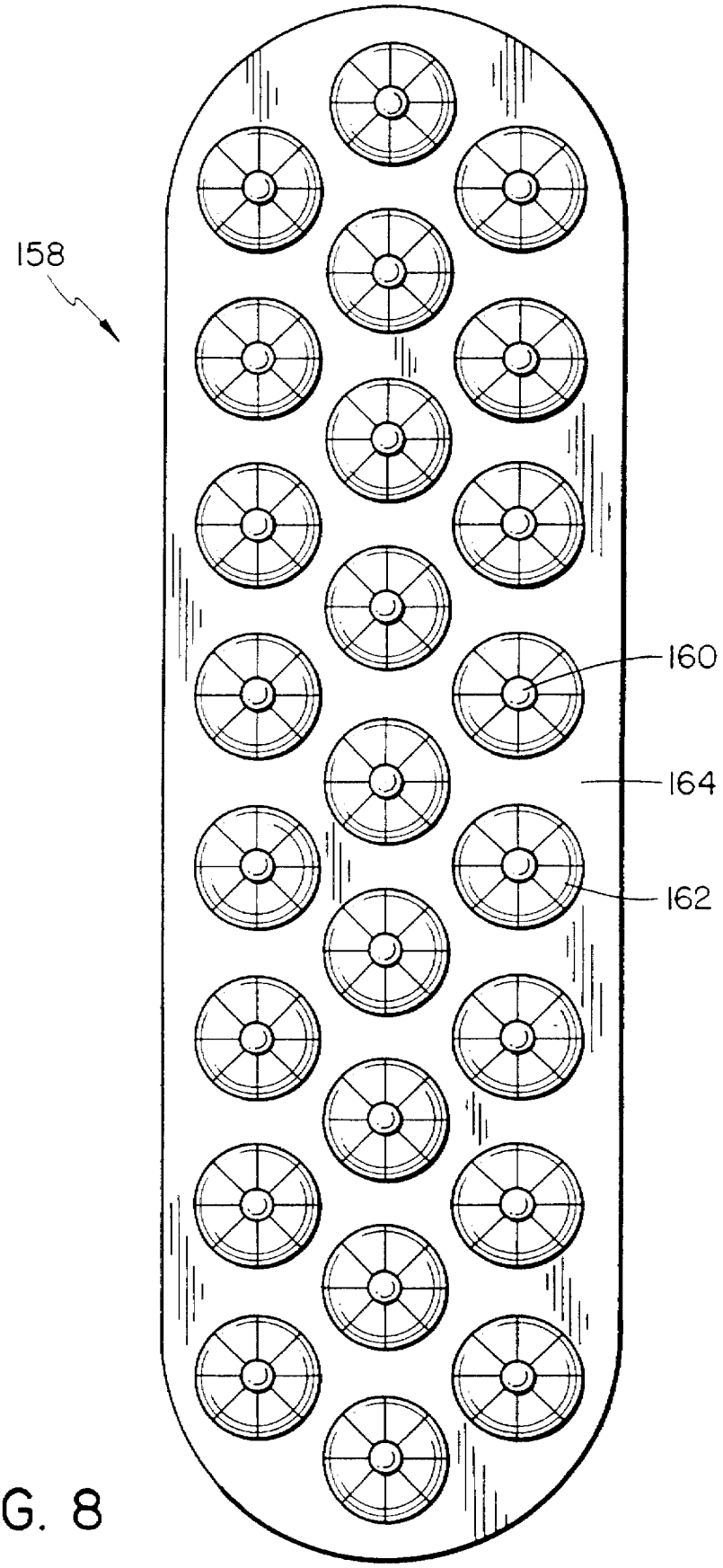
FIG. 8 is a plan view of a bearing system in accordance with the invention
Figure 9:
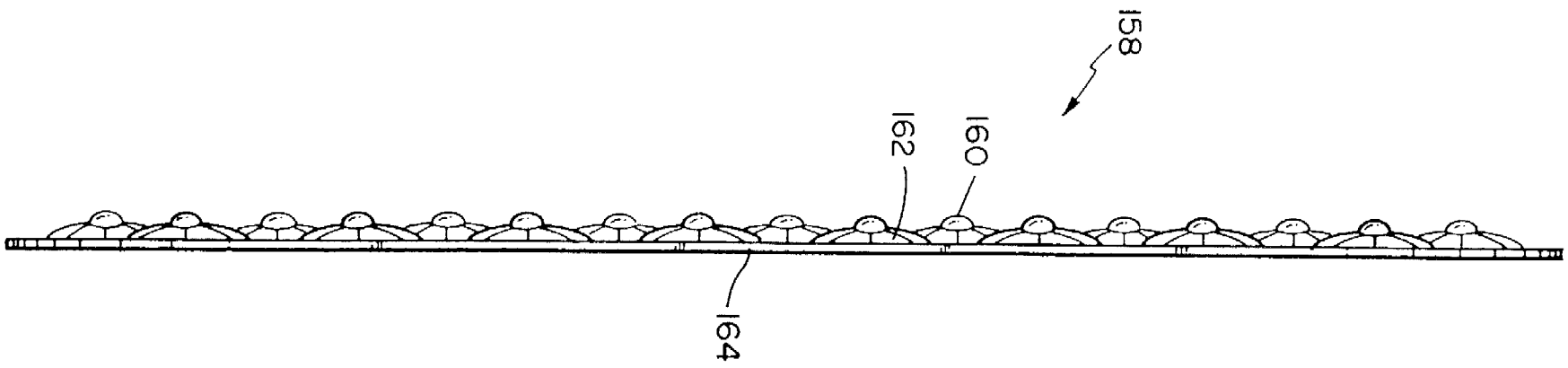
FIG. 9 is a side view of a bearing system in accordance with the invention.

The goalie pad cover 50 may also be provided with a number of sliding surfaces 110, 112, 114, 116 and 118 as shown in FIG. 7. The sliding surfaces are positioned on the goalie pad cover 50 in a number of locations in order to enhance the goalie's ability to slide during play, reduce wear to specific areas and/or to minimize snow or ice build-up on the goalie pad cover 50. The enhanced ability to slide is particularly useful when the goalie pads 10 and covers 50 are used for in-line skate hockey played on a smooth concrete surface, ice hockey or road hockey. A further example of improving play on a concrete surface is the attachment of a ball bearing system 158, as shown in FIGS. 8 and 9, to the outer surface of the goalie pad cover for use on concrete surfaces. FIG. 8 shows a plan view of a typical ball bearing system 158 for use as a sliding surface, the ball bearing system 158 having a ball 160 in socket 162 on base 164. As shown in FIG. 8, the sliding surface is provided with a plurality of ball bearings 160, each ball bearing 160 rotatably received in a socket 162 on a base 164, the plurality of ball bearings 160 forming a raised bearing surface as seen in FIG. 9. Base 164 may be attached by any suitable means to the goalie pad cover 50 at any suitable position where it is desired to enhance the ability of the goalie to slide. It is envisaged within the spirit and scope of the invention that the ball bearing system 158 may either be permanently attached to the goalie pad cover 50 or removeable therefrom where the means of attachment includes but is not limited to sewing or straps and/or fastening tape.

A goalie pad cover 50 may be made of any suitable materials that do not interfere with or hinder the normal use of the goalie pad 10 while providing durability and tear and wear-resistance. Accordingly, it is preferred that the interconnected panels are fabricated from a lightweight, durable, non-stretching, tear and water resistant material such as CORDURA™ nylon, OXFORD™ or QUARTERBACK™. For areas of the cover where it is desirable to limit the potential for snow or ice build-up, a synthetic leather such as JERINO™ or CHLORINO™ may be used. Materials for the sliding surfaces should provide durability and malleability in addition to low friction, such as DURAFLEX™.

The goalie pad 10 and goalie pad cover 50 may also be provided with optional padding devices between the goalie pad 10 and cover 50 to selectively enhance the padding on a particular surface of a pad. It is preferred that if additional padding is desired, the additional padding is attached to the goalie pad cover in the desired location by any of the above attachment means.

In using the above materials for the construction of the goalie pad cover 50, a variety of colours or designs may be implemented in order to conform the cover 50 to the colours or logos of a particular team. Panels of different colours may be used or auxiliary logos 150 sewn to the panels. Individual panels may also be constructed of different materials if desired for aesthetic or functional reasons for a particular goalie pad cover 50.

A goalie pad cover 50 is configured and attached to a goalie pad 10 in the following illustrative manner for a goalie pad cover 50 having a wire 90 conforming means and straps 38. Firstly, the cover 50 is laid face down on a flat surface. The location(s) of the conforming device(s) is(are) determined in accordance with the specific design of the goalie pad 10. If necessary, new channels are made between the front 12 and back 14 surfaces of the goalie pad to allow the wire 90 to pass through the pad 10. The wire 90 is attached to the appropriate hole 88 in the plastic strip 86 and the cover 50 is drawn tightly into the concave surfaces 80 of the pad 10. An appropriate anchoring device such as a washer 120 and locking nut 122 is used anchor the wire 90. The top panel 74 is rolled over the thigh section 24 (this may require loosening of the conforming device) and the underside boot panels 70 and 72 are drawn downwardly and tightly to the underside of the pad 10 and anchored in the appropriate manner. Straps 38 are used draw the cover 50 around the pad 10 by inserting the straps 38 through slits 100 and are tightened by the goalie when putting the pads 10 on in the normal manner. Accordingly, when a goalie removes his/her pads 10, the cover 50 need not be removed from the pads 10.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the claims.

The embodiments of the invention which an exclusive property or privilege is claimed are defined as follows:

1. A goalie pad cover for use with a goalie pad having top, bottom, front, back, medial and lateral surfaces, the goalie pad cover comprising:

a plurality of interconnected panels conforming to the surfaces of the goalie pad;

attachment means on the interconnected panels for holding the interconnected panels to the surfaces of the goalie pad;

conforming means on the inner surface of the interconnected panels for conforming the panels to the outer surfaces of the goalie pad; and wherein the plurality of interconnected panels, attachment means and conforming means are adapted to enable a user to selectively configure the goalie pad cover to the goalie pad or remove the goalie pad cover from the goalie pad.

2. A goalie pad cover as in claim 1 wherein the plurality of interconnected panels include top, thigh, pad bar, knee, shin, and boot panels.

3. A goalie pad cover as in claim 1 wherein the attachment means include top, bottom, and side attachment means.

4. A goalie pad cover as in claim 3 wherein the top attachment means is a pocket for engagement over and around the thigh section, the pocket formed by the top, thigh and pad bar panels.

5. A goalie pad cover as in claim 3 wherein the bottom attachment means comprises left and right toe panels on the boot panel for engagement with respective left and right sides of the bottom surface of the goalie pad.

6. A goalie pad cover as in claim 5 wherein the left and right toe panels are attached to the bottom surface by fastening tape.

7. A goalie pad cover as in claim 1 wherein the interconnected panels are further provided with slide means for reducing wear to the interconnected panels and for increasing the sliding coefficient of the goalie pad cover on a playing surface.

8. The goalie pad cover as in claim 7 wherein the slide means are further provided with a ball bearing system for increasing the sliding coefficient of the goalie pad on a playing surface.

9. The goalie pad cover as in claim 8 wherein the ball bearing system includes a plurality of ball bearings, each ball bearing rotatably received in a socket on a base, the plurality of ball bearings forming a raised bearing surface.

10. The goalie pad cover as in claim 9 wherein the ball bearing system may be selectively attached to or removed from the goalie pad cover.

11. A goalie pad cover as in claim 7 wherein the sliding surfaces are on any one of or a combination of the lateral surface, medial surface, left toe panel, right toe panel and knee panel of the goalie pad cover.

12. A goalie pad cover as in claim 1 wherein the conforming means comprises:

anchoring strip on the interconnected panels for engagement with wire ties, the wire ties each having a first end for engagement with the anchoring strip and a second end for passing from the front to rear surfaces of the goalie pad;

washers for engagement with the second end of the wire tie on the rear surface of the goalie pad;

locking nut for anchoring the second end of the wire tie on the rear surface of the goalie pad.

13. A goalie pad cover as in claim 1 wherein the attachment means are selected from any one of or a combination of straps, laces or buttons between the goalie pad cover and goalie pad.

14. The goalie pad cover as in claim 13 wherein the goalie pad has a plurality of straps for attachment of the goalie pad around a player's leg and the outer edges of the thigh, knee, shin and boot panels are provided with at least one hole to enable the straps to pass through said at least one hole for tightening the goalie pad cover around the goalie pad.

15. A goalie pad cover as in claim 1 wherein the interconnected panels are assembled from any one of or a combination of panels of tear-resistant nylon, synthetic leather and polyethylene.

16. A goalie pad cover as in claim 1 wherein the conforming means are selected from any one of or a combination of hooks and clasps, laces, buttons or wire ties between the goalie pad cover and goalie pad.

17. A goalie pad cover as in claim 1 further comprising padding means on the inside surface of the interconnected panels, selectively positioned to enhance the padding on any or a combination of any surface(s) of the goalie pad.

18. A goalie pad cover as in claim 2 wherein the attachment means include top, bottom, and side attachment means.

19. A goalie pad cover as in claim 17 wherein the interconnected panels are further provided with slide means for reducing wear on the interconnected panels and for increasing the sliding coefficient of the goalie pad cover on a playing surface.

20. The goalie pad cover as in claim 19 wherein the slide means are further provided with a ball bearing system for increasing the sliding coefficient of the goalie pad on a playing surface.

21. A goalie pad cover as in claim 18 wherein the bottom attachment means comprises left and right toe panels on the boot panel for engagement with respective left and right sides of the bottom surface of the goalie pad.

22. A goalie pad cover as in claim 19 wherein the conforming means comprises:

anchoring strip on the interconnected panels for engagement with wire ties, the wire ties each having a first end for engagement with the anchoring strip and a second end for passing from the front to rear surfaces of the goalie pad washers for engagement with the second end of the wire tie on the rear surface of the goalie pad;

locking nut for anchoring the second end of the wire tie on the rear surface of the goalie pad.

23. A goalie pad cover as in claim 21 wherein the top attachment means is a pocket for engagement over and around the thigh section, the pocket formed by the top, thigh and pad bar panels.

24. A goalie pad cover as in claim 22 wherein the interconnected panels are assembled from any one of or a combination of panels of tear-resistant nylon, synthetic leather and polyethylene.

25. A goalie pad cover having inner and outer surfaces for use with a goalie pad having padded thigh, knee, shin, boot, and pad bar sections comprising:

pad bar panel for covering the pad bar section;

thigh panel attached to the pad bar panel for covering the thigh section;

knee panel attached to the thigh panel and pad bar panel for covering the knee section;

shin panel attached to the knee panel and pad bar panel for covering the thigh section;

boot panel attached to the shin panel and pad bar panel for covering the boot section;

left and right side toe panels attached to the left and right side of the boot panel respectively for holding the boot panel against the underside of the boot section;

top panel attached to thigh panel and pad bar panel, the top, thigh and pad bar panels forming a pocket for engagement over and around the thigh section;

conforming means on the inner surface of the goalie pad cover, the conforming means having:

anchoring strip on the interconnected panels for engagement with wire ties, the wire ties each having a first end for engagement with the anchoring strip and a second end for passing from the front to rear surfaces of the goalie pad;

washers for engagement with the second end of the wire tie on the rear surface of the goalie pad;

locking nut for anchoring the second end of the wire tie on the rear surface of the goalie pad.

* * * * *